US008747946B2

(12) United States Patent
Ko et al.

(10) Patent No.: US 8,747,946 B2
(45) Date of Patent: Jun. 10, 2014

(54) PRE-TREATMENT APPARATUS AND METHOD FOR IMPROVING ADHESION OF THIN FILM

(75) Inventors: Kyung Hyun Ko, Seoul (KR); Hyuk Jun Lee, Gyeonggi-do (KR)

(73) Assignee: Ajou University Industry Cooperation Foundation, Gyeonggi-Do (KR)

( * ) Notice: Subject to any disclaimer, the term of this patent is extended or adjusted under 35 U.S.C. 154(b) by 0 days.

(21) Appl. No.: 13/809,206

(22) PCT Filed: Jul. 8, 2011

(86) PCT No.: PCT/KR2011/005004

§ 371 (c)(1),
(2), (4) Date: Jan. 9, 2013

(87) PCT Pub. No.: WO2012/005539

PCT Pub. Date: Jan. 12, 2012

(65) Prior Publication Data

US 2013/0115378 A1 May 9, 2013

(30) Foreign Application Priority Data

Jul. 9, 2010 (KR) ..... 10-2010-0066419

(51) Int. Cl.
*B05D 1/12* (2006.01)
*C23C 24/04* (2006.01)

(52) U.S. Cl.
USPC ..... 427/203; 427/191; 427/205; 427/427

(58) Field of Classification Search
USPC ..... 427/191, 203, 205, 427
See application file for complete search history.

(56) References Cited

U.S. PATENT DOCUMENTS

| | | | | |
|---|---|---|---|---|
| 6,645,566 | B2 * | 11/2003 | Ko | 427/435 |
| 2005/0214474 | A1 * | 9/2005 | Han et al. | 427/446 |
| 2007/0240603 | A1 * | 10/2007 | Ko et al. | 106/1.05 |
| 2008/0102220 | A1 * | 5/2008 | Haynes et al. | 427/421.1 |

FOREIGN PATENT DOCUMENTS

| | | | |
|---|---|---|---|
| JP | 2009-197294 | 9/2009 | C23C 24/08 |
| KR | 10-2006-0114363 | 11/2006 | C23C 4/00 |
| KR | 10-2007-0020808 | 2/2007 | C23C 4/00 |
| KR | 10-2010-0032997 | 3/2010 | C23C 24/04 |
| WO | WO 2007/021091 | 2/2007 | C23C 4/04 |

OTHER PUBLICATIONS

International Search Report (ISR) in PCT/KR2011/005004 dated Feb. 20, 2012.

* cited by examiner

*Primary Examiner* — Frederick Parker
(74) *Attorney, Agent, or Firm* — Harness, Dickey & Pierce, P.L.C.

(57) ABSTRACT

There is provided a pre-treatment method for improving an adhesion of a thin film which includes: preparing a base metal including a single metal or alloy; preparing a coating powder including powder of one or more single metals or an alloy thereof; forming a porous metal coating layer on a surface of the base metal, on which a thin film is to be deposited, by cold-spraying the coating powder and a process gas to the surface of the base metal; and depositing the thin film on the coating layer, wherein the thin film includes metal.

6 Claims, 1 Drawing Sheet

PRE-TREATMENT APPARATUS AND METHOD FOR IMPROVING ADHESION OF THIN FILM

CROSS-REFERENCE TO RELATED APPLICATIONS

This application is a national phase application of PCT Application No. PCT/KR2011/005004, filed on Jul. 8, 2011, which claims the benefit and priority to Korean Patent Application No. 10-2010-0066419, filed Jul. 9, 2010. The entire disclosures of the applications identified in this paragraph are incorporated herein by references.

TECHNICAL FIELD

The inventive concept relates to a pre-treatment method for improving an adhesion when a thin film is deposited, and more particularly, to a pre-treatment apparatus and method for improving an adhesion of a thin film (carbon) when the thin film is deposited on a typical metallic base metal, by forming a porous metal coating layer on a surface of the metallic base metal, on which the thin film is to be deposited, by cold spraying.

BACKGROUND ART

Typically, to deposit a porous carbon on a base metal formed of a metallic material, a porous metal coating layer with a high adhesion needs to be formed on a surface of the base metal on which a thin film is deposited so as to allow metal and carbon to be combined with each other easily.

To do this, as a conventional coating layer forming method, a vacuum deposition method of performing deposition under vacuum conditions and a thermal spray method of performing deposition by heating are widely used.

Regarding the vacuum deposition method, a vapor or ion of metal or non-metal is heated under vacuum conditions and then attached to a base metal (an object to be coated), and regarding the thermal spray method, momentary high pressure heat and a source are simultaneously molten permeation coated on an object to be coated by spraying. Various coating methods including ceramic, metalizing, plasma coating, etc. are used according to a material to be applied.

However, the conventional vacuum deposition method necessarily requires an expensive vacuum chamber, which leads to high manufacturing costs. Also, the vacuum deposition method is not appropriate for forming a thick coating layer. Due to such limitations, the use of the vacuum deposition method is very restricted.

Also, the conventional thermal spray method uses high-temperature heat and thus, it is highly likely that a base metal, to which the heat is transferred, is deformed (distorted, etc.) In particular, if the thickness of the base metal is small, the deformation may easily occur, which makes the formation of a coating layer (also referred to as a buffer layer) difficult.

Accordingly, to resolve the problems described above, the present invention provides an inexpensive method of forming a coating layer with a sufficient adhesion with respect to a base metal at low temperature for a short period of time while deformation of the base metal is prevented when the coating layer is formed.

DISCLOSURE OF INVENTION

Technical Problem

The inventive concept provides a pre-treatment apparatus and method for improving an adhesion of a thin film with respect to a base metal on which the thin film is to be deposited, by forming a porous metal coating layer (buffer layer) on a surface of the base metal by cold-spraying at low costs and at relatively low temperature, while a residual stress between the base metal and the porous metal coating layer is minimized

Solution to Problem

According to an aspect of the inventive concept, there is provided a pre-treatment apparatus for improving an adhesion of a thin film, the pre-treatment apparatus including: a gas compressor that compresses gas supplied from the outside and contained, and supplies a process gas having high pressure; a powder feeder for supplying a coating powder including a single metal or alloy supplied from the outside and contained; and a spray nozzle through which the process gas supplied from the gas compressor and the coating powder supplied from the powder feeder are cold sprayed on a surface of a base metal on which a thin film is to be deposited so as to form a porous metal coating layer on the surface of the base metal.

The pre-treatment apparatus may further include a gas heater for heating the process gas to increase a spray speed of the process gas between the gas compressor and the spray nozzle.

The process gas may have a pressure of 10 to 20 kgf/cm$^2$, the process gas may have a temperature of 550 to 650° C., and the coating powder may be sprayed through the spray nozzle at a speed of 300 to 1200 m/s.

Also, the spray nozzle may be a de Laval-type nozzle for generating an supersonic stream. The gas compressor may supply a predetermined amount of the process gas to the powder feeder so as to smoothly supply the coating powder.

The process gas may include helium, nitrogen, argon, or air.

According to an aspect of the inventive concept, there is provided a pre-treatment method for improving an adhesion of a thin film, wherein the pre-treatment method includes: preparing a base metal including a single metal or alloy; preparing a coating powder comprising powder of one or more single metals or an alloy thereof; forming a porous metal coating layer on a surface of the base metal, on which a thin film is to be deposited, by cold-spraying the coating powder and a process gas to the surface of the base metal; and depositing the thin film on the coating layer, wherein the thin film comprises metal.

The cold-spraying may include: feeding the coating powder into a spray nozzle for coating; and spraying the coating powder on the surface of the base metal by accelerating the coating powder at a speed of 300 to 1,200 m/s using a stream of the process gas flowing in the spray nozzle.

The forming of the porous metal coating layer may further include heat treating the base metal by heating so as to nitride the metallic surface of the base metal.

The heat treating may be performed when the base metal and the coating powder are in a non-molten state.

The forming of the porous metal coating layer may further include heating the process gas using a gas heater.

Advantageous Effects of Invention

As described above, an adhesion between a typical metallic base metal and a thin film (carbon) may be improved by forming a metallic coating layer (buffer layer) on a surface of the base metal, on which the thin film is to be deposited, by cold spraying.

Also, the base metal is not thermally deformed or damaged by thermal impact, and high resistance may be provided to prevent fatigue crack initiation either between the base metal and the coating layer or of the coating layer.

BEST MODE FOR CARRYING OUT THE INVENTION

Hereinafter, exemplary embodiments of the present invention will now be described in detail with reference to attached drawings.

In describing the present invention, terms used herein are defined in consideration of functions in the present invention, and should not be construed as being limiting technical elements used in the present invention.

Figure 1:
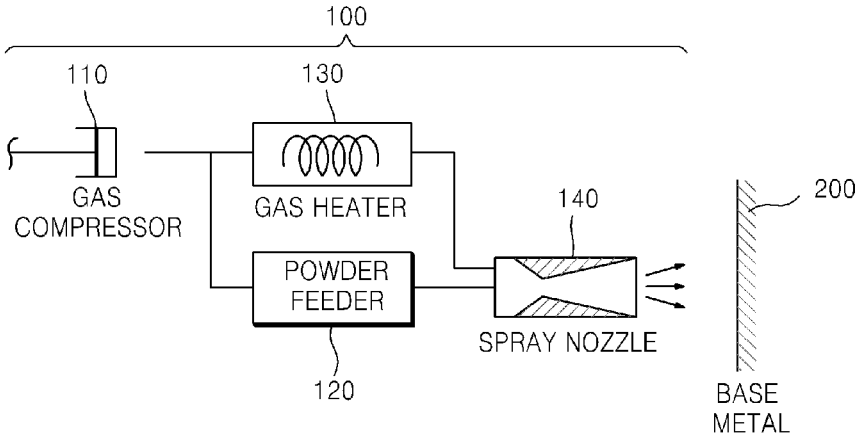
FIG. 1 is a view of a structure of a pre-treatment apparatus for improving an adhesion of a thin film according to an embodiment of the present invention.

Referring to FIG. 1, a pre-treatment apparatus 100 for improving an adhesion of a thin film according to an embodiment of the present invention is used to form a coating layer (buffer layer) for improving an adhesion on a surface of a base metal 200 on which a thin film (carbon, not shown) is to be deposited, by acceleration-spraying powder for forming a coating layer at a subsonic speed or supersonic speed.

To do this, the pre-treatment apparatus 100 includes a gas compressor 110 that compresses gas supplied from the outside and supplies a process gas that is compressed, a powder feeder 120 that supplies a coating powder including a single metal or alloy, and a spray nozzle 140 through which the process gas supplied from the gas compressor 110 and the coating powder supplied from the powder feeder 120 are cold sprayed on a surface of a base metal 200, on which a thin film is to be deposited, so as to form a coating layer for a buffer purpose on the surface of the base metal 200.

The gas compressor 110, the powder feeder 120, and the spray nozzle 140 are conventionally used in the art and accordingly, will not be described in detail herein.

Also, the pre-treatment apparatus 100 may further include a gas heater 130 between the gas compressor 110 and the spray nozzle 140. The gas heater 130 may heat the process gas to increase a spray speed thereof.

The gas heater 130 may be disposed on a gas flow path that connects the gas compressor 110 and the spray nozzle 140, and may apply heat to the compressed process gas so as to increase kinetic energy thereof. A temperature of the heated process gas may be from 550 to 650° C. That is, a spray speed at the spry nozzle 140 may be increased by increasing kinetic energy of the compressed process gas.

Herein, the gas heater 130 is an optional element for enhancing the spray performance of the pre-treatment apparatus 100. Use of the gas heater 130 may be desirable for high performance of the pre-treatment apparatus 100. However, the gas heater 130 is not necessary Also, the process gas that is sprayed from the gas compressor 110 via the spray nozzle 140 may have a pressure of 10 to 20 kgf/cm$^2$ for smooth spraying purpose. Also, the coating powder that is sprayed from the powder feeder 120 via the spray nozzle 140 may be sprayed at a speed of 300 to 1200 m/s via the spray nozzle 140.

The spray pressure range of the process gas described above and the spray speed range of the coating powder described above may be desired. However, the spray pressure of the process gas and the spray speed of the coating powder may not be limited thereto.

Also, to generate a stream with a subsonic speed to supersonic speed, a converging-diverging nozzle may be used as the spray nozzle 140.

The process gas may be helium, nitrogen, argon, or air, and may be appropriately selected in consideration of the spray speed of the spray nozzle 140 and manufacturing costs.

Accordingly, during the process gas supplied by the gas compressor 110 flows, the process gas is heated by the gas heater 130 and thus kinetic energy thereof is increased, and sprayed via the spray nozzle 140 on a surface of the base metal 200 on which a thin film is to be deposited.

Simultaneously, coating powder supplied by the powder feeder 120 is also sprayed to the surface of the base metal 200 together with the process gas, thereby forming a coating layer.

Figure 2:
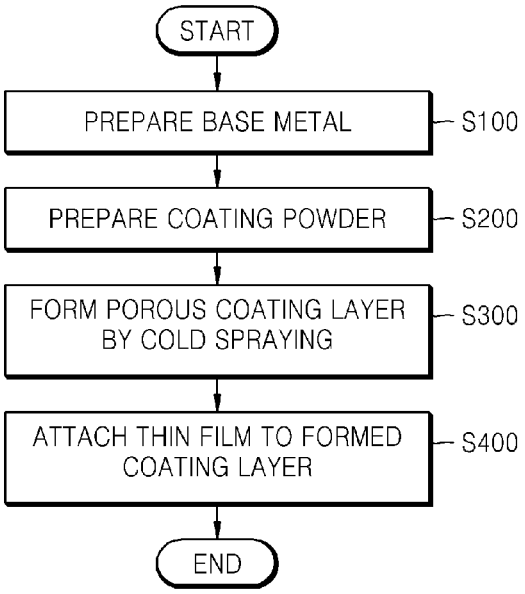
FIG. 2 is a view to explain a pre-treatment method for improving an adhesion of a thin film according to another embodiment of the present invention.

Hereinafter, a pre-treatment method for improving an adhesion of a thin film according to another embodiment of the present invention will be described in detail with reference to FIG. 2. The structures that are already described above will not be presented herein.

First, in operation S100, the base metal 200, to which the thin film (carbon) is to be attached, is disposed in a predetermined position. The base metal 200 may include a single metal or alloy.

In operation S200, a coating powder including powder of one or more single metal or an alloy thereof is prepared. That is, a coating powder for forming the coating layer is supplied to the powder feeder 120 in advance.

In this regard, a metal that is used to form the coating layer may be a metal including a single metal or alloy base at its surface. The single metal refers to one-component metal, and the alloy refers to a metal including two or more metals.

The alloy may include an alloy including a precipitate or a dispersion strengthened product. Also, various materials, such as a metal or alloy that is coated by cold spraying, or a composite or combination that forms an intermetallic compound and includes a single metal or alloy base at its surface may be selectively used.

All single metals or alloys including a metallic element used to form the base metal 200 may also be used herein. As all single metals or alloys as the coating powder, any single metal or alloy including a metallic element may be used.

Also, the coating powder may be one single metal powder, or a mixture of two or more single metal powders, such as a three-component system or four-component system.

For example, a combination of a single metal or alloy of the base metal 200 and the coating powder may be a nickel and copper alloy. Also, the coating powder may include at least one single metal selected from the group consisting of titanium, nickel, chromium, and iron, or may include at least one single metal selected from the group consisting of aluminum and nickel.

Also, the single metal or alloy of the base metal 200 may be nickel or an alloy thereof, and the coating powder may include nickel, aluminum, and an alloy thereof.

The coating powder including such components may have various particle sizes used for known cold spraying. According to powder used, coating efficiency and reactivity may differ. Accordingly, in consideration of such factors, an optimal particle size may be selected.

As described above, it is needed to select an appropriate particle size. If the coating powder has a particle size of 1 to 200 μm, a coating layer having collision energy may be formed.

In operation S300, the coating powder prepared in operation S200 is cold-sprayed on the base metal 200 to form a coating layer for a buffer purpose.

That is, the prepared coating powder is molten sprayed, or cold-sprayed at a temperature that is relatively lower than in a sintering process so as to form a coating layer having collision energy.

In other words, the cold spray method refers to a coating method in which powder is adhered to a subject due to an energy that is generated when the powder collides with the subject using a supersonic gas induced by compression and expansion.

Unlike conventional methods in which coating powder is coated by heating, the cold spray coating is performed even at room temperature so that deformation and degeneration of a material are preventable, and abrasion resistance, fatigue resistance, heat resistance, and erosion resistance may be substantially improved.

In particular, in the cold spray method according to the present invention, the prepared coating powder is fed into the spray nozzle 140 and then, the coating powder is accelerated at a speed of 300 to 1,200 m/s due to a stream of the process gas flowing in the spray nozzle 140, and sprayed to the surface of the base metal 200.

Also, the operation S300 may further include heat treating the base metal 200 by heating at a predetermined temperature to nitride a metallic surface. In this regard, the heat treatment may be performed when the base metal 200 and the coating powder, which include metallic materials, are in a non-molten state.

That is, in the cold spray coating, the base metal 200 may be treated at room temperature or low temperature, or treated after heated to a predetermined temperature or higher. In the latter case, accumulation of strain energy generated by collision of the coating powder and deep collision of the coating powder may be induced.

Also, the operation S300 may further include heating the process gas by using a gas heater. In this regard, a temperature of heated process gas may be 550 to 650° C.

Finally, in operation S400, a thin film formed of metal may be attached to the porous metal coating layer formed on the surface of the base metal 200 in operation S300.

In this regard, the thin film (carbon) may be deposited by metalorganic chemical vapor deposition (MOCVD), which is a desirable method. Meanwhile, sputtering and e-beam deposition may also be used herein. By doing so, the thin film (carbon) may be strongly attached to a surface of the base metal 200 on which the coating layer is formed.

In conclusion, by forming the coating layer (buffer layer) on the surface of the base metal 200, on which the thin film is to be deposited, by cold spraying, an adhesion between a typical metallic base metal and a thin film (carbon) may be improved. Also, thermal deformation or thermal impact-induced damage of the base metal 200 may not occur, and high resistance that is sufficient to prevent a fatigue crack initiation either between the base metal 200 and the coating layer or of the coating layer is provided.

As described above, a pre-treatment apparatus and method for improving an adhesion of a thin film according to embodiments of the present invention are described with reference to the attached drawings. However, the embodiments are exemplary only and do not limit the scope of the present invention.

Accordingly, it is obvious that one of ordinary skill in the art may change and imitate dimensions, shapes and structures within the scope of the present invention, and such change and imitation are also within the scope of the present invention.

INDUSTRIAL APPLICABILITY

This invention can be used in the field of forming a coating layer to the base metal.

What is claimed is:

1. A pre-treatment method for improving an adhesion of a thin film, the pre-treatment method comprising:

preparing a base metal comprising a single metal or alloy;

preparing a coating powder having a particle size of 1 to 200 μm comprising powder of one or more single metals or an alloy thereof;

forming a porous metal coating layer for buffering on a surface of the base metal, on which a thin film is to be deposited, by cold-spraying the coating powder and a process gas to the surface of the base metal; and depositing a thin carbon film on the coating layer by using metalorganic chemical vapor deposition, sputtering or e-beam deposition, wherein the thin carbon film comprises metal.

2. The pre-treatment method of claim 1, wherein the cold-spraying comprises:

feeding the coating powder into a spray nozzle for coating; and spraying the coating powder on the surface of the base metal by accelerating the coating powder at a speed of 300 to 1,200 m/s using a stream of the process gas flowing in the spray nozzle.

3. The pre-treatment method of claim 2, wherein the spray nozzle is a de Laval-type nozzle.

4. The pre-treatment method of claim 1, wherein the forming of a porous metal coating layer further comprises heating the process gas by a gas heater.

5. The pre-treatment method of claim 1, wherein the deposition of the thin carbon film on the coating layer is carried out by metalorganic chemical vapor deposition.

6. The pre-treatment method of claim 2, wherein the process gas has a temperature of 550 to 650° C. and a pressure of 10 to 20 kgf/cm$^2$.

* * * * *